United States Patent [19]

Leifeld et al.

[11] 4,392,275

[45] Jul. 12, 1983

[54] APPARATUS FOR SUPPORTING FIBER BALES

[75] Inventors: Ferdinand Leifeld, Kempen; Hans-Jürgen Marx; Rolf Scheuermann, both of Monchen-Gladbach, all of Fed. Rep. of Germany

[73] Assignee: Trützschler GmbH & Co. KG, Monchen-Gladbach, Fed. Rep. of Germany

[21] Appl. No.: 246,694

[22] Filed: Mar. 23, 1981

[30] Foreign Application Priority Data

Mar. 21, 1980 [DE] Fed. Rep. of Germany ..... 3010937

[51] Int. Cl.[3] ..... D01G 7/06

[52] U.S. Cl. ..... 19/81; 241/101 A

[58] Field of Search ..... 19/80 R, 81; 241/101 A, 241/101.7

[56] References Cited

U.S. PATENT DOCUMENTS

| | | | |
|---|---|---|---|
| 4,109,875 | 8/1978 | Condarco | 19/80 R |
| 4,176,425 | 12/1979 | Trützschler | 19/81 |
| 4,297,767 | 11/1981 | Leifeld | 19/80 R |

FOREIGN PATENT DOCUMENTS

| | | | |
|---|---|---|---|
| 2800714 | 7/1979 | Fed. Rep. of Germany | 19/80 R |
| 1350857 | 12/1963 | France | 19/80 R |
| 1528453 | 4/1968 | France | 19/80 R |

*Primary Examiner*—Louis Rimrodt

*Attorney, Agent, or Firm*—Spencer & Kaye

[57] ABSTRACT

A bale supporting apparatus for stabilizing fiber bales during opening of the fiber bales from the top includes a support element arranged to engage a vertical end face of a bale and further arranged for stepwise, vertically downwardly oriented motion as the bale height decreases during the bale opening process. The support element is mounted on a stationary carrier structure which is situated horizontally adjacent the space occupied by the fiber bales undergoing opening.

17 Claims, 12 Drawing Figures

APPARATUS FOR SUPPORTING FIBER BALES

BACKGROUND OF THE INVENTION

This invention relates to an apparatus for supporting fiber bales while the fiber bale opening (plucking) process is in progress. The opening is effected by an opening device which may include a plurality of toothed discs executing consecutive passes above the bales and removing fiber quantities from the top thereof. The support apparatus includes a support element which engages a vertical bale face oriented perpendicularly to the direction of travel (working direction) of the opening device. Such vertical bale face will be referred to as "end face". The support element gradually advances downwardly as the bale opening process is in progress (and thus the height of the bales decreases).

Certain types of fiber bales expand upwardly to a substantial extent as the bale straps are removed so that the risks are high that such unrestrained bales may topple after positioning them (for example, on the floor by a fork lift) for the opening operation. This applies particularly to the first and last bale of a bale row formed of serially arranged bales. During the bale plucking (opening) process, as the opening apparatus makes its passes over the bales, even a slight pressure on the upper surfaces of the bales or a lateral pressure effected during the opening process, may cause a fiber bale to topple, particularly if such a bale was initially unstable. Further, the fiber bales have the tendency to slightly deflect away under the required operational pressure during the opening process, resulting in a reduction of the output. In a known bale supporting apparatus, support elements are provided which are mounted on a carrier structure arranged in the working direction, that is, in the direction of the end faces of the fiber bales. Such an apparatus cannot find a satisfactory application in case of a fiber bale series where between the individual fiber bale groups intermediate spaces are provided, because in such a case the opening apparatus would collide with the carrier structure.

SUMMARY OF THE INVENTION

It is an object of the invention to provide an improved bale supporting apparatus of the above-outlined type from which the discussed disadvantages are eliminated and which makes possible to support the end faces of the bales even in the intermediate spaces between the individual fiber bale groups.

This object and others to become apparent as the specification progresses, are accomplished by the invention, according to which, briefly stated, the support element has at least one support face and the carrier device for the support element is situated laterally of the space occupied by the fiber bales.

Thus, in essence, the apparatus according to the invention has at least one movable support element including a support face pressed against the end face of a fiber bale. The higher the location where the bale is supported, that is, the closer the support face is to the opening device, the better is the holding effect and the efficiency of the opening process. Since during the opening process the height of the bale decreases, it is necessary to move the support element gradually downwardly. The carrier for the support element is so situated that it is clear of the opening range of the opening elements. Consequently, no part of the carrier structure can interfere with the opening device as the latter executes its passes above the bales. By providing that the carrier structure is situated laterally of the space taken up by the fiber bales, even those bale end faces which bound the intermediate spaces between fiber bale groups can be supported without interfering with the traveling path of the opening device.

Preferably, the position of the support element above the floor on which the fiber bales are positioned, may be altered. There is no need to lower the support element below the floor level on which the bales stand. Expediently, the support element is secured to the carrier structure with the intermediary of a holding element, such as a holding arm, providing a two-part construction.

At the beginning of the opening operation the support element of the support apparatus is set at its highest position. The opening element, dependent upon the feed height, presses, upon each pass, the support element downwardly by a step corresponding to the feed height; thus, the height position of the support element is automatically adapted to the top bale level where the opening process is performed. The stability of the fiber bales is particularly threatened at the beginning of the opening process, thus, when opening is performed at a substantial bale height. After about one-half of the bale has been opened, the positional stability of the bales has been increased to such an extent - due to the height reduction of the bale - that the support elements are no longer required. After the support faces of the support elements have been pressed in their lowermost position against the end faces of the bales, the opening device may be automatically stopped, for example, by means of a command signal derived from such lowest position of the support faces. Thereafter, the support elements may be swung out, for example, manually. For this purpose, the support element or its holding element is articulated to the carrier structure by means of a joint situated laterally of the fiber bales. Expediently, the support element, or its holding element is rotatable in a vertical plane, so that when, during the course of the opening process, no further support of the fiber bales is required, the support elements may be swung upwardly into an inoperative position. It may be of advantage to provide for a rotary motion of the support element or its holding element in the horizontal plane, so that the support element may be pivoted out laterally into an inoperative position.

The carrier structure for the support elements preferably has a horizontally oriented carrier shaft which may be of tubular configuration and which is mounted on stationary uprights. The vertical pivotal shaft may be a tubular member which is situated at a distance from the bales and is arranged as a barrier laterally along the entire bale assembly. The joints are shiftable on the shaft so that the support elements may be set into any desired position. In this manner, the position of the support elements can be adapted to any pattern of bale assembly, particularly groups of unlike bales defining between themselves intermediate clearances.

In case of fiber bales where the risk of tipping over is not high, the arrangement according to the invention provides that the support element is brought into contact only with one end face of the fiber bale in case the opening element exerts a pressure on the fiber bale only during passes in a single direction. The rotary joint which is situated at one end of the support element or its holding element may be a sleeve or similar component which is inserted on the carrier tube. Preferably, the support element, together with its holding arm, is horizontally displaceable on the carrier shaft of the carrier structure, so that the support faces may be brought into engagement with and pressed against, the respective end faces of the fiber bales. The support element may be immobilized in its set position by a tightening device such as a sleeve with a setscrew. The support faces may be pressed against the respective end faces of the fiber bales in such a manner that, by virtue of the friction between the support face and the bale, the own weight of the entire carrier structure is cancelled out so that - in case no other forces affect the support faces - the latter remain spatially stationary. Advantageously, the support element, together with its holding element can be pressed resiliently against the end face of the fiber bale by a spring (such as a leaf spring). In this manner, the support faces may follow the surface inequalities of the end faces as the support faces slide downwardly thereon. According to a preferred embodiment, the support elements engaging opposite end faces of a bale group are connected in pairs by means of at least one tension spring. Such spring may be arranged between the pivotal arm and the top face of the bale or between two support elements associated with one bale assembly.

According to a further feature of the invention, the support face is, in the zone of its lower edge, bent away from the end face of the fiber bale to ensure that the support element may deflect as a result of surface inequalities in the bale face as the support element moves downwardly during operation. Expediently, the support element has, in the zone of that edge which is oriented toward the opening device, a weight which provides that the support element may automatically swing from the working (supporting) position into a withdrawn (outwardly pivoted) position.

According to a further feature of this invention, the support element is rotatably coupled to the holding element (holding arm) by means of a joint. The support element is secured to a swinging arm which is pivotal about an axis situated externally of the fiber bale opening zone. The support element is coupled with the swinging arm by an articulation, so that the support element, while pressed downwardly, may be maintained continuously in a position parallel to itself. The holding element is preferably provided in the vicinity of the joint with the support element with a further articulation whose pivot pin is oriented perpendicularly away from the support face in the working position. Expediently, the support element is arranged shiftably on the pivot pin to ensure that as the support element glides downwardly, it is capable of following an uneven surface of the fiber bale.

It is a significant feature of the invention that the holding arm and the support element automatically advance downwardly as the opening operation is in progress. This may be effected, for example, by electric means such as a controlled stepping motor or the like. Preferably, the opening element presses mechanically the support element or the holding arm to move one step downwardly upon each pass of the opening device.

DESCRIPTION OF THE PREFERRED EMBODIMENTS

Figure 1A:
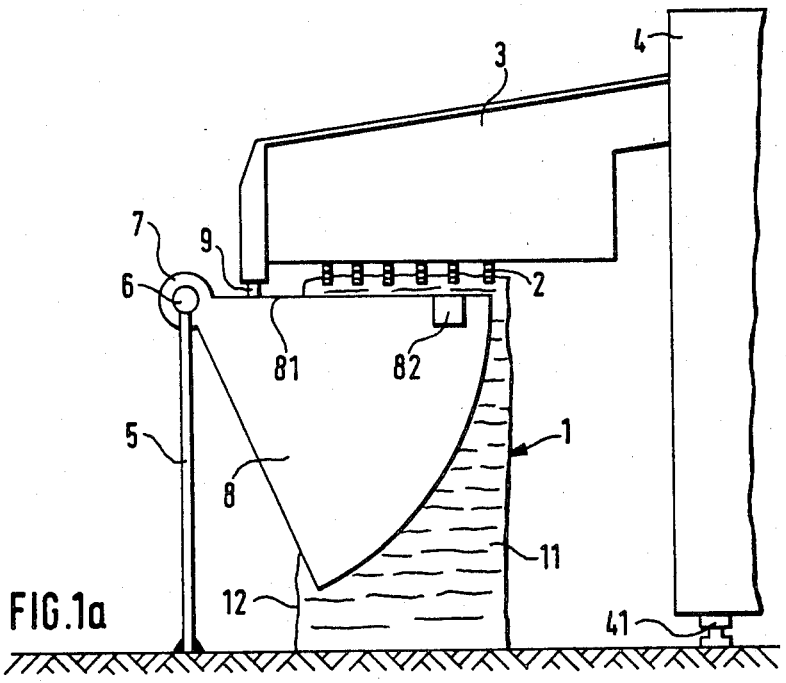
FIGS. 1*a* and 1*b* are schematic front elevational views of a preferred embodiment of the invention shown, respectively, in an operative and in a withdrawn, inoperative position.
Figure 1B:
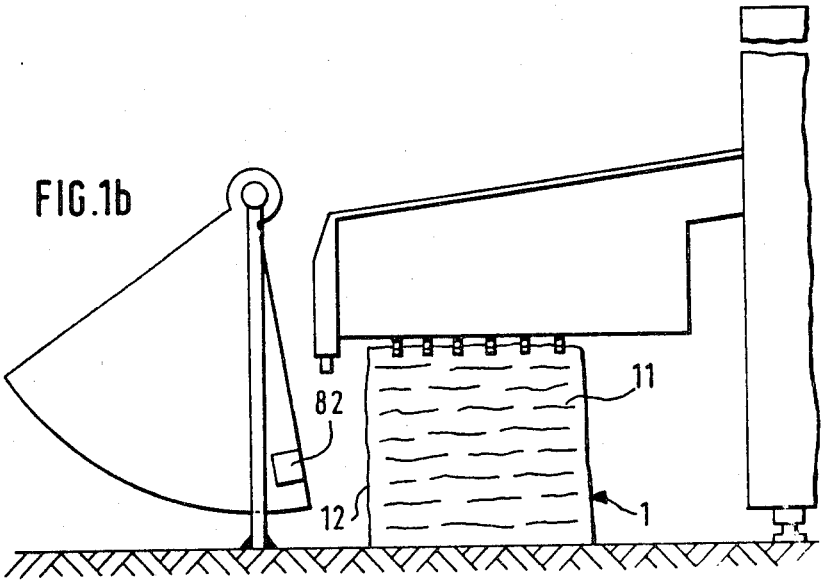
Figure 2:
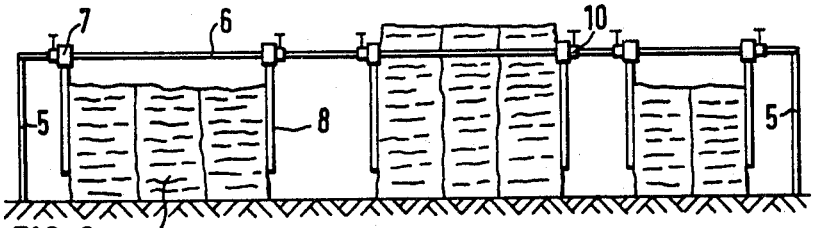
FIG. 2 is a schematic side elevational view of the embodiment shown in FIGS. 1*a* and 1*b*.

Turning now to FIGS. 1*a*, 1*b* and 2, there are shown fiber bales 1 of a fiber bale assembly to be opened from the top, for example, by means of rotary toothed discs (opening elements) 2 supported in an opening head 3 mounted on a truck 4 which travels on rails 41. The fiber bales rest on the floor. On that side of the fiber bales 1 which is oriented away from the truck 4 there are anchored uprights 5 which carry a horizontal shaft 6 extending parallel to the fiber bale series. The components 5 and 6 which may be tubular, form a carrier assembly for a bale support element, such as a support plate 8 swingably mounted on the shaft 6 by a sleeve joint 7. The support plate 8 has the shape of a circular segment and is arranged for pressing, with a support face, against a vertical end face 11 of the fiber bale 1. Dependent upon spatial requirements, the support plate 8 may be formed of two relatively movable components which can be opened and closed in a fan-like manner. The support plate 8 has a weight 82 in the zone of a bounding edge 81. FIG. 1*a* shows the support plate 8 in its operative, supporting position; it is seen that the plate 8 engages the greatest part of the end face 11 of the fiber bale 1 in its upper zone. Upon each pass of the opening apparatus 2, 3, 4, an actuating element 9 which is mounted at the outer end of the opening head 3, presses, for example, a rubber-rimmed wheel on the edge 81 of the support plate 8. As a result, the apparatus plate 8 moves downwardly one step by turning clockwise about the shaft 6. When during the opening process the fiber bale 1 has been reduced to such a height that a further support may be dispensed with (since the fiber bale, due to its reduced height, has obtained a certain stability), the support plate 8, under the effect of the weight 82, swings into the position shown in FIG. 1*b*. Such a swinging motion is made possible because of the then-reduced friction between the support plate 8 and the end face 11 of the fiber bale 1. It is of importance in this embodiment that the carrier assembly 5, 6, is, both in the working position and in the withdrawn position of the support plate 8, at such a distance from the lateral faces 12 of the fiber bales 1 that the traveling path for the opening head 3 remains unobstructed at all times.

In FIG. 2 the fiber bale assembly is formed of three groups. On the carrier assembly 5,6 there are mounted a plurality of spaced support plates 8 with their respective articulation 7, so that the outer end face of each outermost bale in each group is engaged by a respective support plate 8. Each articulation 7 is associated with a tightening device 10 which may be formed by a sleeve and setscrew for immobilizing—after appropriate horizontal adjustment—the respective support plate 8 on the carrier shaft 6.

Figure 3:
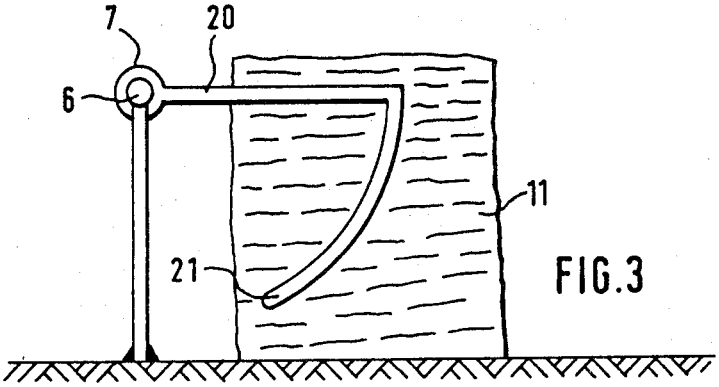
FIG. 3 is a schematic front elevational view of another preferred embodiment of the invention.

Turning now to FIG. 3, the bale support element is formed of a straight arm 20 which at one end is mounted on the carrier shaft 6 by a joint 7 and extends in its horizontal position approximately two-thirds the width of the end face 11 of the fiber bale. The straight arm 20 continues in a downwardly oriented arcuate arm 21.

Figure 4A:
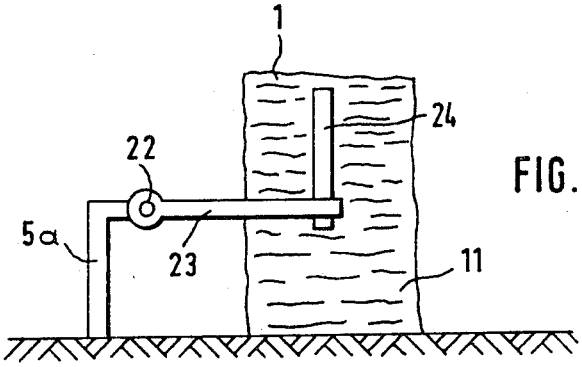
FIGS. 4*a* and 4*c* are schematic front elevational views of a further preferred embodiment of the invention, depicted in an operative and an inoperative position, respectively.
Figure 4B:
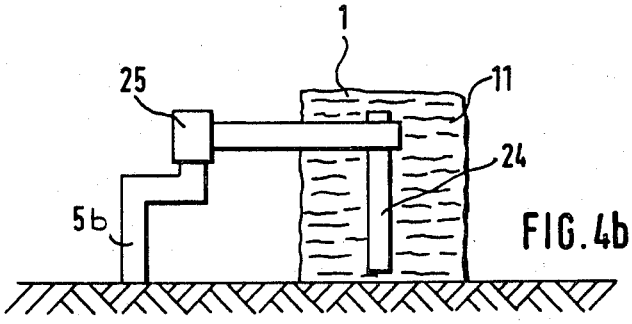
FIGS. 4*b* and 4*d* are, respectively, schematic front elevational and top plan views of a further preferred embodiment depicted, respectively, in an operative and in an inoperative position.
Figure 4C:
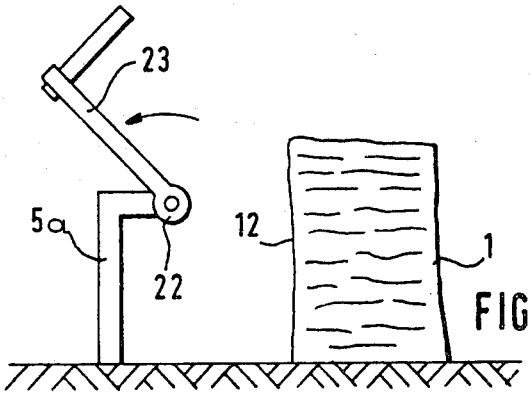

Turning now to FIGS. 4*a* and 4*c*, there is shown another preferred embodiment of the invention, according to which at the upper end of an upright 5*a* there is mounted a joint 22 for rotation about a horizontal axis extending parallel to the bale series. A holding arm 23 is attached at one end to the joint 22 and has, at its other end, a bore through which extends a bale support element, such as a support bar 24. The support bar 24 is displaceable in a direction perpendicular to the length dimension of the holding arm 23. As shown in FIG. 4*a*, in the operative position of the bale supporting apparatus, a support face of the support bar 24 is in engagement with the upper part of the end face 11. FIG. 4*c* shows the arrangement in a swung-out, inoperative position.

Figure 4D:
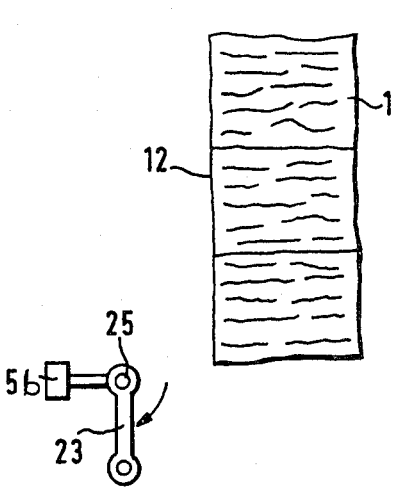

Turning now to FIGS. 4*b* and 4*d*, the embodiment shown therein is similar to that illustrated in FIG. 4*a*, except that a joint 25 mounted on the upper end of an upright 5*b* is rotatable about a vertical axis. As seen in FIG. 5*b*, in the operative position the work face (support face) of the support bar 24 engages the lower zone of the end face 11 of the fiber bale 1. FIG. 4*d* shows the apparatus in a swung-out position pivoted laterally outwardly about the joint 25. In the inoperative positions illustrated in FIGS. 4*c* and 4*d*, the holding arm 23 is swung approximately into the space between the lateral face 12 of the bales and the top of the respective uprights 5*a* or 5*b*.

Figure 5A:
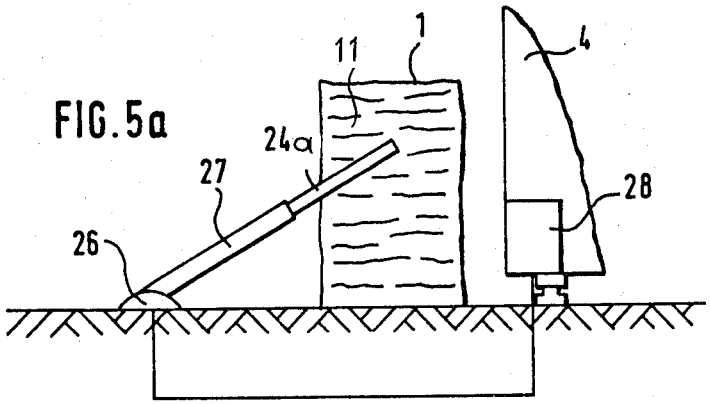
FIGS. 5*a* and 5*b* are schematic front elevational views of still another preferred embodiment of the invention depicted in an operative and, respectively, in a withdrawn, inoperative position.
Figure 5B:
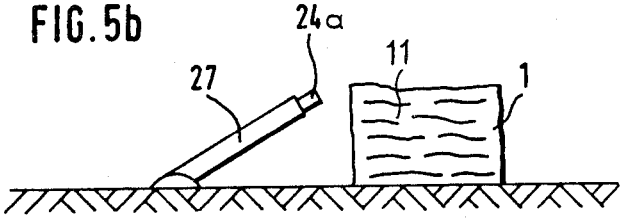

Turning now to FIGS. 5*a* and 5*b*, in a bearing 26 supported on the floor, there is held a tube 27 extending obliquely upwardly in the direction of the fiber bales. In the tube 27 there is telescopically held a bale support bar 24*a* which has a support face oriented towards the end face 11 of the fiber bales. The support bar 24*a* thus may assume an extended position as shown in FIG. 5*a* (operative position) and an inwardly telescoped position (withdrawn position) as shown in FIG. 5*b*. For varying the telescoped position of the support bar 24*a*, a stepping motor (not shown) is provided which receives electric stepping signals from a program control 28 associated with the opening apparatus 2, 3, 4. Thus, the downward feed of the opening elements 2 after each pass of the opening apparatus 2, 3, 4 is electrically coupled with the stepwise downward advance of the support bar 24*a*.

Figure 6A:
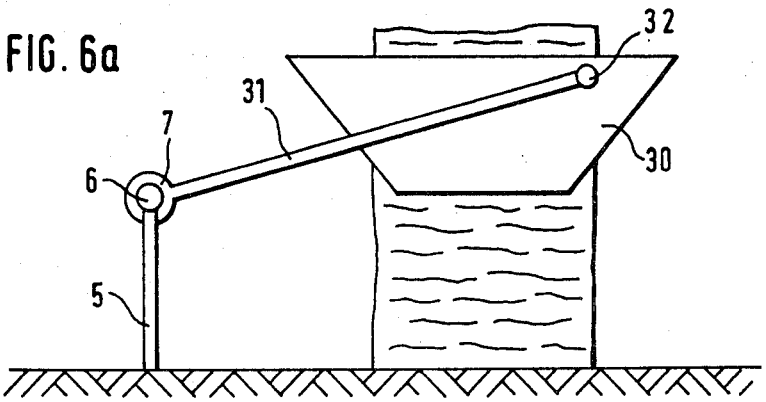
FIGS. 6*a* and 6*b* are schematic front elevational and side elevational views, respectively, of still another preferred embodiment of the invention depicted in an operative position.
Figure 6B:
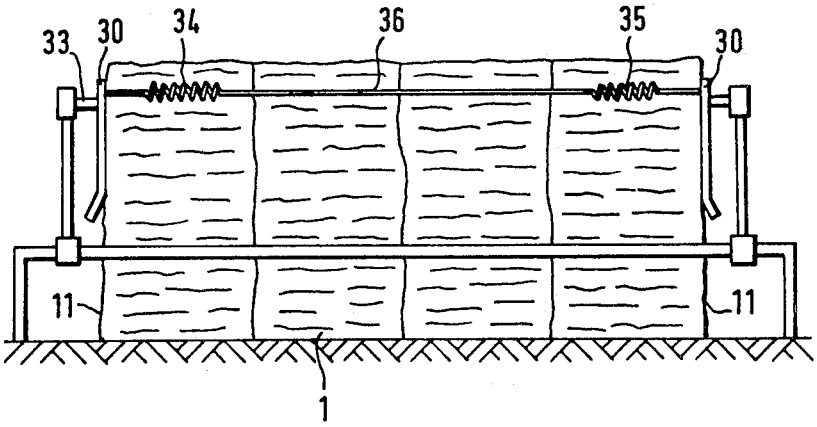

Turning now to FIGS. 6*a* and 6*b*, the preferred embodiment shown therein includes bale support plates 30 which have a trapezoidal configuration and which are mounted on the carrier shaft 6 by means of a holding arm 31 and a joint 7. Each support plate 30 is rotatably connected with the respective holding arm 31 by means of an articulation 32.

The joint 32 has a pivot pin 33 which extends, when the bale supporting apparatus is in the work position, perpendicularly to the support plate 30. The support plate 30 is shiftable on the pin 33 in a direction parallel to the bale series. Two support plates 30 associated with a single bale group and engaging opposite end faces of the outermost bales of the group are interconnected by two tension springs 34, 35 as well as a cable 36. The support plates 30 are, in the zone of their lower edge, bent away from the frontal face 11 of the fiber bale 1.

It will be understood that the above description of the present invention is susceptible to various modifications, changes and adaptations, and the same are intended to be comprehended within the meaning and range of equivalents of the appended claims.

What is claimed is:

1. In a bale supporting apparatus for stabilizing fiber bales during opening of the fiber bales from the top; the apparatus including a support element arranged to engage a vertical end face of a bale and further arranged for stepwise, vertically downwardly oriented motion as the bale height decreases during the bale opening process; the improvement comprising a stationary carrier structure situated horizontally adjacent the space occupied by the fiber bales undergoing opening and mounting means for movably securing said support element to said carrier structure.

2. A bale supporting apparatus as defined in claim 1, wherein said support element is adjustable above a supporting surface on which the bales stand.

3. A bale supporting apparatus as defined in claim 1, wherein said mounting means comprises a holding arm securing said support element to said carrier structure.

4. A bale supporting apparatus as defined in claim 3, further comprising a joint for rotatably mounting said support element on said holding arm.

5. A bale supporting apparatus as defined in claim 4, wherein said support element is a support plate and further wherein said joint comprises a pivot pin extending perpendicularly to said support plate.

6. A bale supporting apparatus as defined in claim 5, wherein said support plate is shiftable on said pivot pin.

7. A bale supporting apparatus as defined in claim 1, wherein said carrier structure comprises a horizontal support shaft carrying said support element.

8. A bale supporting apparatus as defined in claim 7, wherein said support element is displaceable horizontally on said support shaft.

9. A bale supporting apparatus as defined in claim 8, further comprising force-exerting means for urging said support element against an end face of the bale with a resilient force.

10. A bale supporting apparatus as defined in claim 9, wherein said force-exerting means comprises at least one spring.

11. A bale supporting apparatus as defined in claim 10, wherein said spring is attached to a first said support element and to a second said support element; the first and second support elements being pulled towards one another by said spring whereby said spring presses the first and second support elements to oppositely oriented bale end faces.

12. A bale supporting apparatus as defined in claim 1, wherein said support element has a support face for direct engagement with a bale end face and a lowermost marginal portion bent away from a plane of contact between the support face and the bale end face.

13. A bale supporting apparatus as defined in claim 1, wherein said mounting means provides for a rotary displaceability of said support element in a vertical plane.

14. A bale supporting apparatus as defined in claim 13, further comprising a weight mounted on said support element for swinging said support element by gravity to a position lateral of the space occupied by the bales.

15. A bale supporting apparatus as defined in claim 1, wherein said mounting means comprises a joint for articulating said support element to said carrier structure; said joint being situated horizontally adjacent the space occupied by the fiber bales undergoing opening.

16. A bale supporting apparatus as defined in claim 1, wherein said mounting means provides for a rotary displaceability of said support element in a horizontal plane.

17. A bale supporting apparatus as defined in claim 1, in combination with a fiber bale opening apparatus, including an opening head arranged to execute opening passes above the bales whereby the bales are opened from the top; further comprising means mounted on said opening head and cooperating with said support element for pressing downwardly said support element by one step during each pass of said opening head.

* * * * *